US009889957B2

(12) United States Patent
Hatsuno et al.

(10) Patent No.: US 9,889,957 B2
(45) Date of Patent: Feb. 13, 2018

(54) DRUG PACKAGING DEVICE

(71) Applicant: PANASONIC HEALTHCARE CO., LTD., Toon-shi, Ehime (JP)

(72) Inventors: Akinori Hatsuno, Toon (JP); Hiroshi Hama, Toon (JP)

(73) Assignee: PANASONIC HEALTHCARE HOLDINGS CO., LTD., Tokyo (JP)

( * ) Notice: Subject to any disclaimer, the term of this patent is extended or adjusted under 35 U.S.C. 154(b) by 619 days.

(21) Appl. No.: 14/141,937

(22) Filed: Dec. 27, 2013

(65) Prior Publication Data

US 2014/0109514 A1 Apr. 24, 2014

Related U.S. Application Data

(63) Continuation of application No. PCT/JP2012/066799, filed on Jun. 29, 2012.

(30) Foreign Application Priority Data

Jun. 30, 2011 (JP) ..... 2011-146415

(51) Int. Cl.
*B65B 41/16* (2006.01)
*B65B 41/18* (2006.01)
(Continued)

(52) U.S. Cl.
CPC ..... *B65B 41/16* (2013.01); *B65B 41/18* (2013.01); *B65B 57/06* (2013.01); *B65H 20/24* (2013.01);
(Continued)

(58) Field of Classification Search
CPC ..... B65B 9/06–9/093; B65B 41/00; B65B 41/12; B65B 41/16; B65B 61/00;
(Continued)

(56) References Cited

U.S. PATENT DOCUMENTS 2,385,353 A * 9/1945 Frankel ..... G03D 15/043 156/509
2,457,995 A * 1/1949 Frankel ..... G03D 15/043 156/509
(Continued)

FOREIGN PATENT DOCUMENTS

JP 2001-072003 A 3/2001
JP 2001-335202 A 12/2001
(Continued)

OTHER PUBLICATIONS

Chinese Office Action dated Jul. 3, 2014, issued in corresponding Chinese Patent Application No. 201280030202.X with partial English translation (10 pages).
(Continued)

*Primary Examiner* — Thanh Truong
*Assistant Examiner* — Dariush Seif
(74) *Attorney, Agent, or Firm* — Westerman, Hattori, Daniels & Adrian, LLP

(57) ABSTRACT

A drug packaging device is provided in which both sheets are easily connectable to each other with a simple construction. A working plate having a first portion for temporarily fixing an end portion of a sheet remaining at a drug filling unit side, and a second portion for temporarily fixing an end portion of a new sheet are provided. The end portions of the respective packaging sheets which are temporarily fixed at the first portion and the second portion are connectable to each other.

10 Claims, 12 Drawing Sheets

(51) Int. Cl.
*B65B 57/06* (2006.01)
*B65H 20/24* (2006.01)
*B65B 9/06* (2012.01)

(52) U.S. Cl.
CPC ..... *B65B 9/06* (2013.01); *B65H 2301/45* (2013.01); *B65H 2301/5111* (2013.01); *B65H 2301/5151* (2013.01); *B65H 2301/51432* (2013.01); *B65H 2511/512* (2013.01); *B65H 2553/412* (2013.01); *B65H 2801/81* (2013.01)

(58) Field of Classification Search
CPC ..... B65H 19/126; B65H 19/1815; B65H 19/1831; B65H 19/1842; B65H 19/1852
USPC ..... 53/389.1–389.4, 550, 562, 568; 156/502, 156/157; 242/554, 554.1
See application file for complete search history.

(56) References Cited

U.S. PATENT DOCUMENTS 4,486,262 A * 12/1984 Woodley ..... G11B 23/113 156/502
4,682,742 A * 7/1987 Woodley ..... G11B 23/113 156/506
5,779,851 A 7/1998 Ifkovits et al.
6,301,862 B1 * 10/2001 Yuyama ..... B65H 16/04 242/421.4
7,228,988 B2 * 6/2007 Inamura ..... G07F 11/44 221/241
7,770,355 B2 * 8/2010 Inamura ..... B65B 5/103 53/131.4
2003/0121593 A1 * 7/2003 Monroe ..... B65H 19/1852 156/157
2006/0272763 A1 * 12/2006 Tiefel ..... B65H 19/1852 156/157

FOREIGN PATENT DOCUMENTS

JP 2005-75401 A 3/2005
JP 2010-023999 A 2/2010
JP 02-42281 U 3/2013
TW 201008837 A 3/2010
WO 2010/010874 A1 1/2010
WO WO 2010010874 A1 * 1/2010 ..... B65H 19/1852

OTHER PUBLICATIONS

International Search Report for PCT/JP2012/066799, dated Oct. 2, 2012.
Notification of Transmittal of Translation of the International Preliminary Report on Patentability (Form PCT/IB/338) of International Application No. PCT/JP2012/066799 dated Jan. 16, 2014 with Forms PCT/IB/373 and PCT/ISA/237.
Extended European Search Report dated Feb. 25, 2015, issued in corresponding European Application No. 12804635.6. (4 pages).

* cited by examiner

DRUG PACKAGING DEVICE

TECHNICAL FIELD

The present invention relates to a drug packaging device that is loaded with a rolled sheet and configured to package the sheet while drugs are filled in the sheet.

BACKGROUND ART

There is known a drug packaging device that is loaded with a rolled sheet and configured to package the sheet while drugs are filled in the sheet. When the loaded sheet is used up, this device needs a work of exchanging a new sheet.

The drug packaging device has a long and complicated feeding path because filling of drugs, packaging, etc. are performed in a limited space. Therefore, a work of removing all the loaded sheet remaining on the feeding path and perfectly setting a new sheet when the loaded sheet is exchanged by the new sheet is troublesome. In order to simplify this sheet exchange work, a method of connecting an end portion of the sheet remaining in the device and an end portion of the new sheet has been proposed, and a method of manually connecting both the end portions with a double-sided adhesive tape or a structure having a construction of positioning both the sheets, setting an adhesive tape on a center stage provided between the sheets and connecting both the sheets by this adhesive tape have been proposed (see Patent Documents 1 and 2, for example).

PRIOR ART DOCUMENTS

Patent Document

Patent Document 1: JP-A-2010-23999
Patent Document 2: JP-A-2001-72003

SUMMARY OF THE INVENTION

However, in the method of manually connecting the end portion of a sheet to the end portion of a new sheet by using a double-sided adhesive tape, it is difficult for an inexperienced person to properly connect both the end portions, and there has been a risk that the end portions are obliquely connected to each other or the connection state thereof is insufficient.

Furthermore, the construction for positioning both the sheets and setting the adhesive tape to the center stage provided between the sheets has a mechanism for operating respective parts containing the center stage. Therefore, the number of parts increases and the structure is complicated, so that this construction is disadvantageous to reduction of the cost.

The present invention has been implemented in view of the foregoing situation, and has an object to provide a drug packaging device that can easily connect both sheets with a simple construction.

This specification contains all the content of Japanese Patent Application No. 2011-146415 on Jun. 30, 2011.

In order to attain the above object, according to the present invention, drug packaging device having a roll type sheet mounted therein and a feeding mechanism for feeding the sheet to a drug filling unit while applying tension to the sheet, is characterized by comprising: a first portion for temporarily fixing an end portion of a sheet remaining at the drug filling unit side; and a second portion for temporarily fixing an end portion of a new sheet, wherein the ends of the sheets temporarily fixed to the first portion and the second portion are connectable to each other.

In the above construction, the first member and the second portion may be formed in one plate.

In the above construction, a housing in which the feeding mechanism is accommodated may have a front door covering the feeding mechanism, and the plate may be provided so as to be exposed to a front side when the front door is opened.

In the above construction, the plate may be provided so as to be freely swingable so that the obverse and reverse surfaces thereof are exposable to a front side.

In the above construction, the plate may be set along a flat plane extending in an orthogonal direction from at least any one of a shaft of a predetermined feeding roller of the feeding mechanism and a rotational shaft of a roll around which the sheet is wound.

In the above construction, the feeding roller may be located upstream of a movable roller that applies tension to the sheet.

In the above construction, the sheet is a doubled rolled sheet.

In the above construction, the end portions of the respective sheets may be connectable to each other under a state that a packaging unit containing the feeding mechanism is disposed in the drug packaging device.

According to the present invention, the first portion for temporarily fixing the end portion of the sheet remaining at the drug filling unit side and the second portion for temporarily fixing the end portion of the new sheet are provided, and the end portions of the sheets temporarily fixed to the first portion and the second portion are connectable to each other. Therefore, a worker can easily perform a sheet connection work with a simple construction.

DETAILED DESCRIPTION

An embodiment of the present invention will be hereunder described with reference to the drawings.

Figure 1:
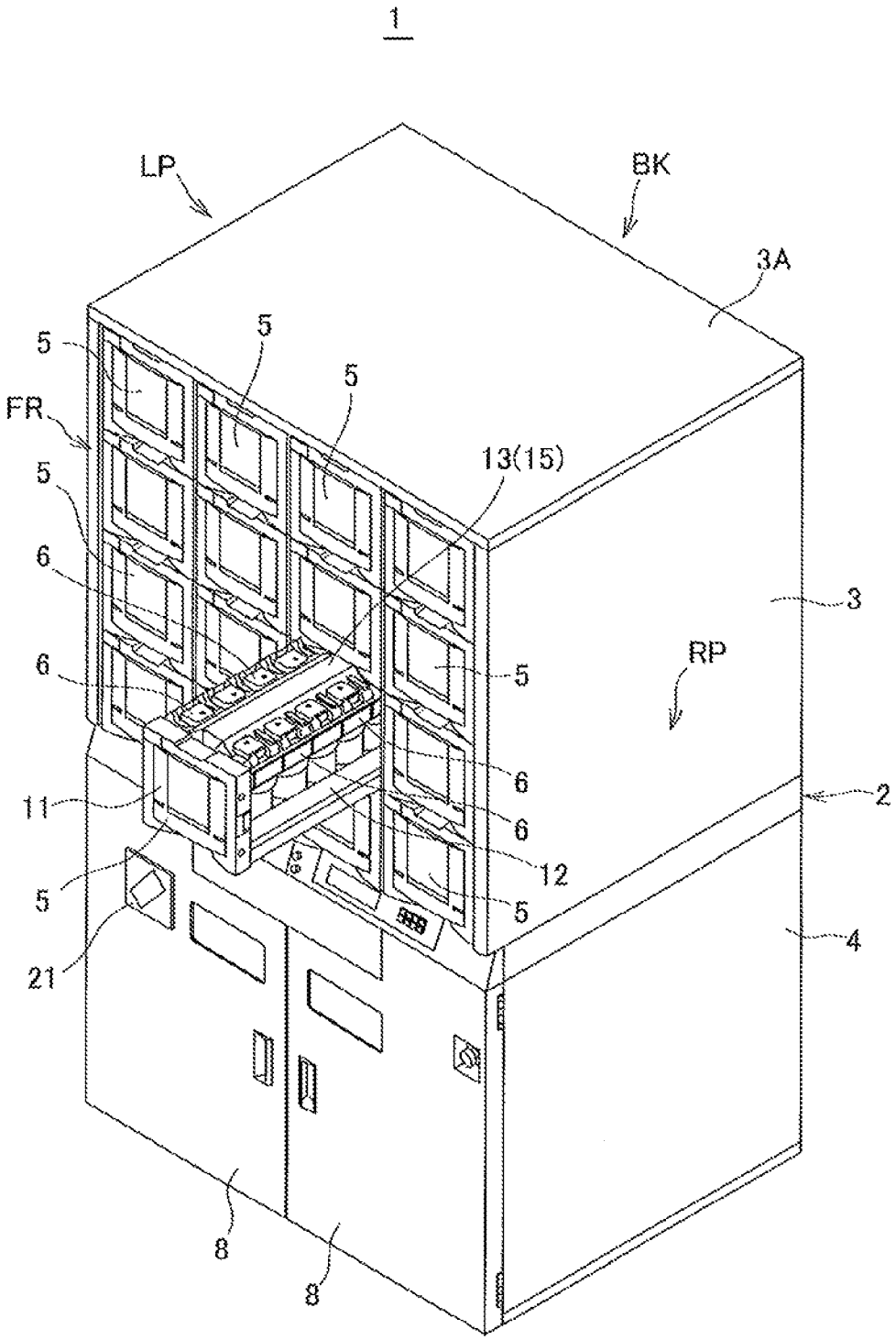
FIG. 1 is a perspective view showing a drug packaging device according to an embodiment of the present invention.
Figure 2:
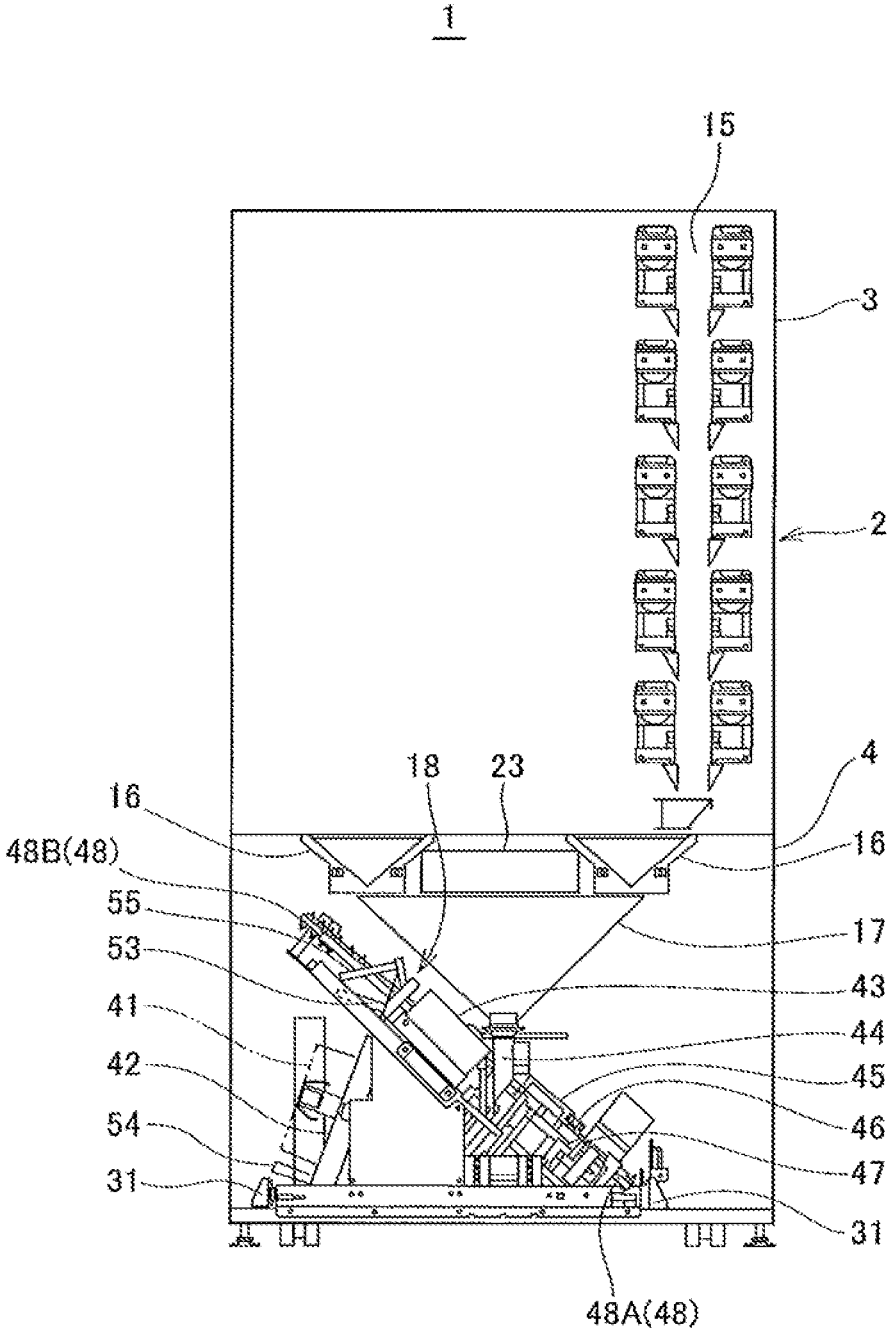
FIG. 2 is a diagram showing the internal structure of the drug packaging device.

FIG. 1 is a perspective view showing a drug packaging device 1 according to an embodiment of the present invention, and FIG. 2 shows the internal construction of the drug packaging device. In FIG. 1, the front surface (front side) of the drug packaging device 1 is represented by reference character FR, the back surface thereof is represented by reference character BK, the right surface thereof is represented by reference character RP and the left surface is represented by reference character LP.

The drug packaging device 1 is disposed in a hospital or a dispensing pharmacy. All the steps from extraction of tablets till packaging, in which drugs (tablets, capsules or the like) of kinds and numbers described on a prescription are discharged from tablet cases 6 one by one, passed through a chute 15 (see FIG. 2) serving as a passage for naturally dropping the drugs by using the weight of the drugs, collected at one place by a hopper 17 (see FIG. 2) and then packaged in a packaging sheet (sheet) S, are automated and performed in a series of mechanisms.

As shown in FIG. 1, the drug packaging device 1 has a vertically long rectangular main body (housing) 2, and a personal computer 101 described later for controlling the drug packaging device 1. The main body 2 has an upper structure 3 and a lower structure 4 which are mutually separable from each other, and configured so that the upper structure 3 is joined onto the lower structure 4. The upper structure 3 functions as a drug accommodating unit for accommodating plural tablet cases in which drugs are put, and the upper surface thereof is covered by a detachable top plate 3A.

The upper structure 3 is provided with plural shelves 5 constituting multi-column and multi-stage drawers of four columns in the right-and-left direction and five stages in the up-and-down direction (totally twenty drawers), and each shelf 5 is configured to be drawable to the front side of the drug packaging device 1. A door panel 11 is secured to the front end (front surface) of each shelf 5, and the respective door panels 11 block the opening of the front surface of the upper structure 3 under the state that all the shelves 5 are accommodated in the upper structure 3.

Driving bases 12 in which plural tablet cases 6 can be arranged on two rows in the right-and-left direction, and a passage 13 which is vertically opened between the tablet cases 6 on the two rows in the right-and-left direction are provided in each shelf 5 so as to extend in the depth direction. The passages 13 constitute chutes 15 for downwardly dropping drugs discharged from the tablet cases 6 of the shelves 5 arranged in the up-and-down direction. In this embodiment, the chutes 15 of four columns in the right-and-left direction are formed.

The front surface and the upper surface of the lower structure 4 are opened. The lower structure 4 intercommunicates with the upper structure 3 at the upper surface thereof. As shown in FIG. 2, a pair of right and left shutters 16, 16 provided below the chutes 15, a single hopper 17 provided below the shutters 16, 16, a packaging unit 18 provided below the hopper 17, etc. are accommodated and mounted in the lower structure 4. The opening of the front surface of the lower structure 4 is configured to be freely openable and closable by double door type front doors 8, 8 (see FIG. 1).

A take-out port 21 is formed in the front door 8 at the left side of the front surface. The take-out port 21 is provided to take out a package filled with predetermined kinds and numbers of drugs, and packages filled with drugs are discharged to the take-out port 31.

As shown in FIG. 2, the right and left shutters 16, 16 have a rectangular funnel shape which has a broadly opened upper surface and is tapered to the lower end thereof. They are opened and closed by shutter solenoids 123 described later, and temporarily receive drugs dropping from the respective chutes 15 to the hopper 17. An additional drug feeder (UTC) 23 is provided between the shutters 16, 16 so as to be freely drawn to the front side. The additional drug feeder 23 is a feeder for arbitrarily supplying drugs to be added, and it intercommunicates with the inside of the hopper 17.

The hopper 17 has a rectangular funnel shape which has a broadly opened upper surface and is tapered to the lower end thereof. The hopper 17 receives drugs dropping from the respective chutes 15 and the additional drug feeder 23, and supplies the drugs to a nozzle 44 below the hopper 17.

The packaging unit 18 is detachably screwed to a pair of right and left drawing rails 31, 31 which are secured to the right and left side of the bottom surface of the lower structure 4. Accordingly, the packaging unit 13 is allowed to be freely drawn from the inside of the lower structure 4 to the front side thereof under the state that the front doors 8, 8 are opened. Furthermore, the packaging unit 13 is attachable and detachable to and from the drawing rails 31, 31 under the drawn state.

Figure 3:
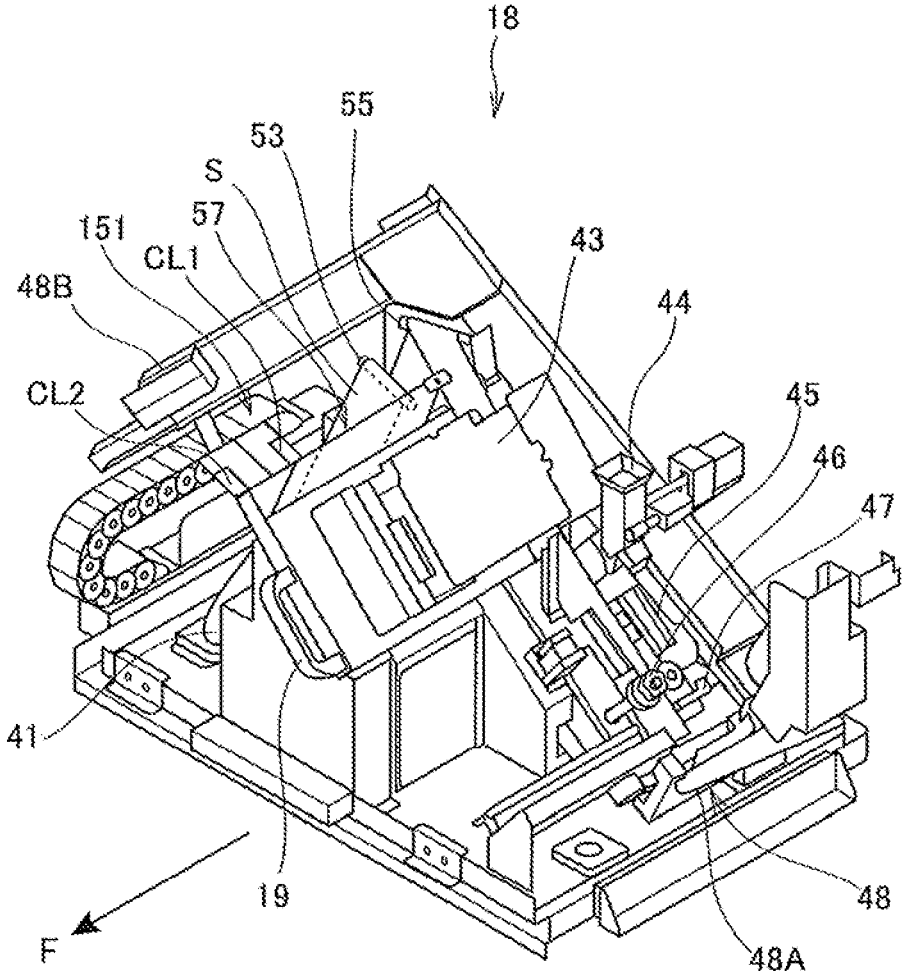
FIG. 3 is a perspective view showing a packaging unit when the packaging unit is viewed obliquely from a front upper right side.
Figure 4:
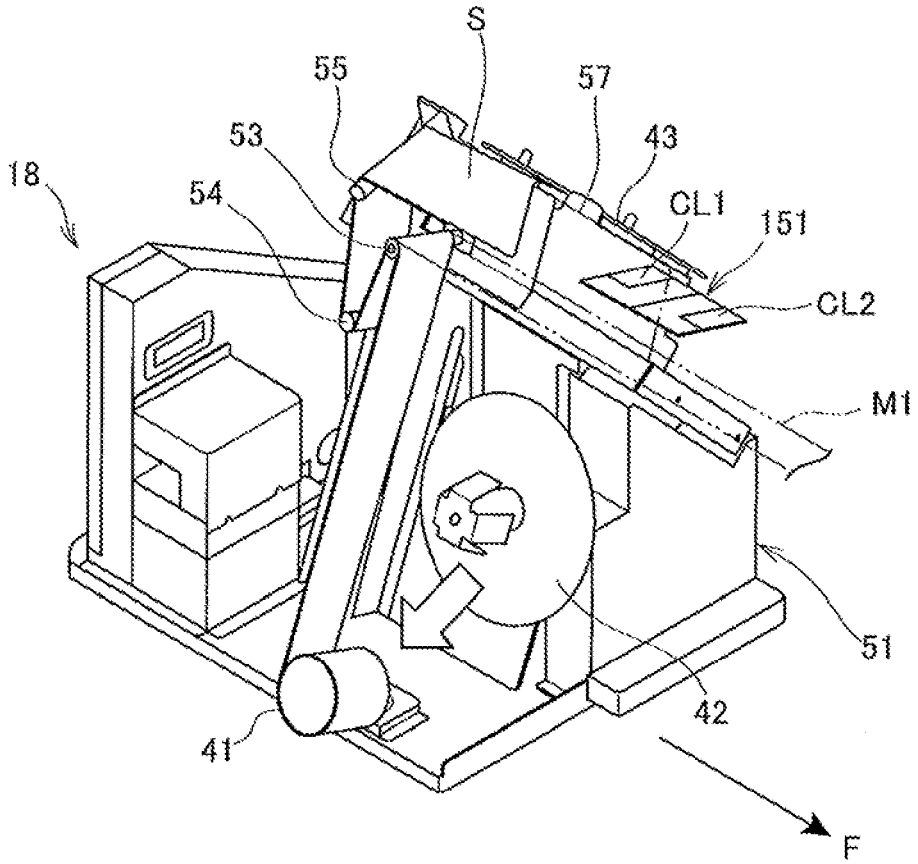
FIG. 4 is a perspective view showing the drug packaging device when the drug packaging device is viewed obliquely from a front upper left side.

FIG. 3 is a perspective view of the packaging unit 18 when the packaging unit 18 is viewed obliquely from the front upper right side, and FIG. 4 is a perspective view showing the drug packaging device 1 when the drug packaging device 1 is viewed obliquely from the front upper left side. In FIG. 3, an arrow represented by reference character F represents the drawing direction of the packaging unit 18 when the packaging unit 18 is drawn to the front surface side of the drug packaging device 1, and reference numeral 19 represents a grip used to draw the packaging unit 18.

As shown in FIGS. 3 and 4, the packaging unit 18 has a sheet supply board 42 on which a roll 41 having a thermally-sealable rolled packaging sheet S is detachably mounted, a printer unit 43 functioning as a print unit for printing characters and figures such as barcodes, etc. on the packaging sheet S, a nozzle 44 functioning as a drug filling unit for filling drugs in the packaging sheet S, a thermal seal head 45 functioning as a packaging unit for closing the packaging sheet S filled with drugs by thermal sealing, a feeding roller 46 constituting a feeding mechanism for feeding the packaging sheet S drawn out from the roll 41, a cutter 47 for cutting the packaging sheet S, and a conveyor unit 48 for feeding the packaging sheet S having drugs packaged therein (package) to the take-out port 21. The sheet supply board 42, the printer unit 43, the nozzle 44, the thermal seal head 45, the feeding roller 46, the cutter 47 and the conveyor unit 48 are successively arranged from the upstream side in this order along the feeding passage of the packaging sheet S. FIG. 4 shows a state that the roll 41 is removed from the sheet supply board 42.

The packaging unit 18 has a box body 51 standing upwards from the center of the bottom surface in the right-and-left direction in the lower structure 4. Parts (a driving motor for the thermal seal head 45, a driving mechanism for a movable roller 54 described later, etc.) which are not visually exposed to the outside of the packaging unit 18 are arranged in the box body 51, and members which are visually exposed to the outside of the packaging unit 13 are arranged by using spaces at the right, left, upper and back sides.

More specifically, at the left side of the box body 51 are arranged the sheet supply board 42, a first feeding roller 53 for first guiding the packaging sheet S drawn obliquely from the roll 41 of the sheet supply board 42 to the upper right side and folding the packaging sheet S downwards, a movable roller 54 for applying tension to the packaging sheet S downstream of the first feeding roller 53, and a second feeding roller 55 for guiding the packaging sheet S downstream of the movable roller 54 and folding the packaging sheet S so that the packaging sheet S directs to the entrance of the printer unit 43 as shown in FIG. 4. A feeding passage for feeding the packaging sheet S to the printer unit 43 while applying tension to the packaging sheet S is constructed by the above members.

The first feeding roller 53 is fixed at a higher position than the roll 41 mounted on the sheet supply board 42. Therefore, when the roll 41 is exchanged, the packaging sheet S drawn out from the roll 41 can be easily wound by a worker (user). Furthermore, the rotational shafts of the first feeding roller 53, the movable roller 54 and the roll 41 mounted on the sheet supply board 42 are parallel to one another, and extend obliquely to the upper left side in an oblique direction which is near to a substantially horizontal direction. On the other hand, the rotational shaft of the second feeding roller 55 is not parallel to the above rotational shafts. The rotational shafts of the first feeding roller 53, the movable roller 54 and the roll 41 mounted on the sheet supply board 42 may be properly changed insofar as they are parallel to one another and can be arranged in the space at the left side of the box body 51, and the second feeding roller 55 may be also positionally properly changed.

As shown in FIG. 3, the upper surface of the box body 51 is formed as a sloped surface which is sloped to the lower right side. The printer unit 43 is disposed on the upper surface of the box body 51, and the packaging sheet S is passed through the printer unit 43, and fed to the lower right side. The lower end of the nozzle 44, the thermal seal head 45, the feeding roller 46 and the cutter 47 are successively arranged in this order at the lower right side of the printer unit 43, and the upstream end 48A of the conveyor unit 48 is located at the right side of the cutter 47. The conveyor unit 48 extends obliquely to the upper left side behind the box body 51, and then it bends and extends forwards at the rear left side of the box body 51. The conveyor unit 48 is provided with a rear end 48B at a position where the conveyor unit 48 intercommunicates with the take-out port 21 of the front door 8 (see FIG. 1).

Next, the basic operation of the drug packaging device 1 will be described.

The roll 41 is obtained by rolling an elongated packaging sheet S while the packaging sheet S is beforehand doubled (folded in half), and the roll 41 is mounted on the sheet supply board 42 while the axis of the roll 41 is tilted to the lower right side with respect to the horizontal plane (see FIG. 2). The packaging sheet S is fed by the feeding roller 46, whereby the packaging sheet S is successively passed through the first feeding roller 53, the movable roller 54 and the second feeding roller 55 in this order and then fed to the printer unit 43. The surface of the packaging sheet S is printed by the printer unit 43, and numerals are printed in ascending order like 0, 1, 2, 3, etc. in this embodiment.

Subsequently, the doubled packaging sheet S is spread at the open side thereof so that the cross-sectional shape thereof is V-shaped, filled with drugs discharged from the nozzle 44 through the open side, pinched from both the sides thereof and thermally sealed by the thermal seal head 45, and then packaged at a predetermined package size while the packaging sheet S is compartmented every package. Thereafter, the packaging sheet S is cut into proper lengths with the cutter 47, and fed and discharged to the take-out port 21 by the conveyor unit 48 (see FIG. 1) whereby packages filled with desired kinds and numbers of drugs are created one by one.

Figure 5:
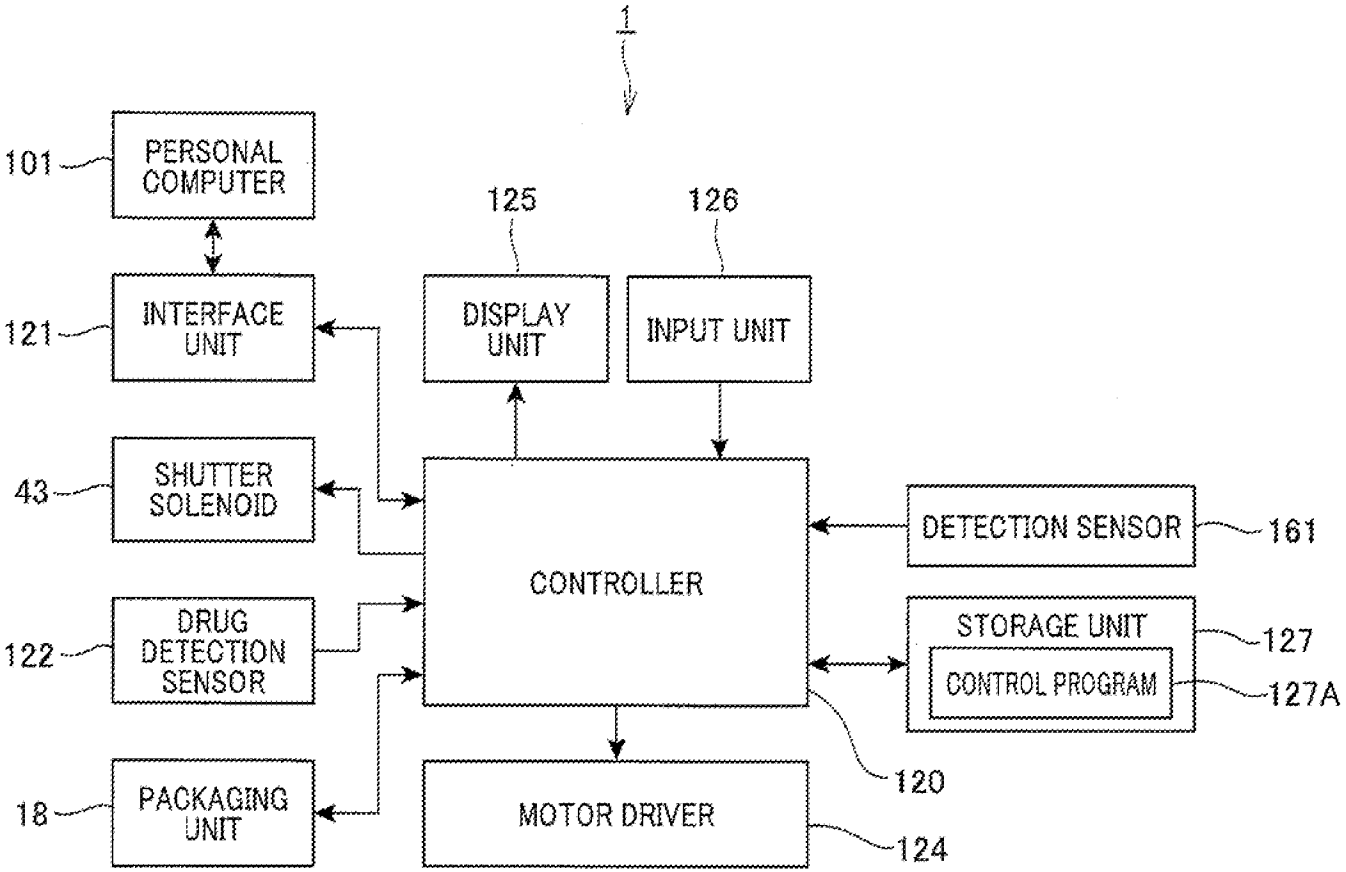
FIG. 5 is a block diagram showing the functional construction of the drug packaging device.

FIG. 5 is a block diagram showing the functional construction of the drug packaging device 1.

A controller 120 centrally controls the respective parts of the drug packaging device 1, and has CPU (Central Processing Unit) as operation executing means, ROM (Read Only Memory) in which a basic control program executed by CPU, data associated with the basic control program, etc. are stored in a non-volatile fashion, RAM (Random Access Memory) in which programs executed by CPU, data associated with the programs, etc. are temporarily stored, other peripheral circuits, etc. The controller 120 executes various kinds of time counting operations and time counting of the present time on the basis of reference clocks generated by an oscillator (not shown).

The controller 120 is connected to the packaging unit 18, an interface unit 121, a drug detection sensor 122, the shutter solenoid 123, a motor driver 124, a display unit 125, an input unit 126 and a storage unit 127.

Under the control of the controller 120, the packaging unit 18 creates packages filled with predetermined drugs, and feeds the created packages to the take-out port 21 by the conveyor unit 48.

The interface unit 121 is connected to a personal computer 101 through a signal communication cable or the like, and receives/transmits various kinds of signals from/to the personal computer 101 under the control of the controller 120. This construction enables the personal computer 101 and the drug packaging device 1 to receive and transmit various kinds of data therebetween, and also enables a worker (user) to execute various instructions to the drug packaging device 1 through the personal computer 101.

The drug detection sensor 122 detects drugs discharged from the tablet cases 6, and outputs a detection value to the controller 120. The controller 120 counts the number of drugs discharged from the tablet cases 6 on the basis of the detection value input from the drug detection sensor 122. The shutter solenoid 123 operates the shutters 16, 16 under the control of the controller 120. The motor drive 124 is connected to various kinds of motors equipped to the packaging unit 18, and supplies driving current to these motors to control the operation of the motors under the control of the controller 120.

The display unit 125 displays various kinds of information under the control of the controller 120. The input unit 126 accepts a worker's input operation, and outputs it to the controller 120. The storage unit 127 is constructed by EEPROM or a flash memory, and stores various kinds of data in a rewritable fashion under the control of the controller 120. In the storage unit 127 are stored a control program 127A executed by the controller 120, etc.

In this embodiment, when the roll 41 is exchanged there is performed a work of drawing the packaging unit 10 to the front side through the drawing rails 31, 31 and connecting a packaging sheet S remaining at the packaging unit 18 side and a packaging sheet S of a new roll 41 through a tape. The method of performing this connection work does not need to completely remove a used packaging sheet S and set a new packaging sheet S on the complicated feeding passage, and also has an advantage that the used packaging sheet S can be used at the maximum level to avoid waste of resources. However, the connection work itself is liable to be cumbersome.

Therefore, this embodiment is provided with a working plate 151 serving as a working table on which the connection work is performed.

<Concerning the Working Plate>

As shown in FIG. 3, the working plate 151 is located to be exposed to the front side when the front doors 8, 8 of the lower structure 4 are opened. More specifically, the packaging unit 18 is provided with a partitioning plate 57 through which the upper side of the box body 51 is partitioned into the right and left parts, and the working plate 151 is secured at the upper and front side of the partition plate 57. The roller group 53 to 55 located on the upstream side of the printer unit 43 and the printer unit 43 are separated from each other through the partition plate 57.

Figure 6:
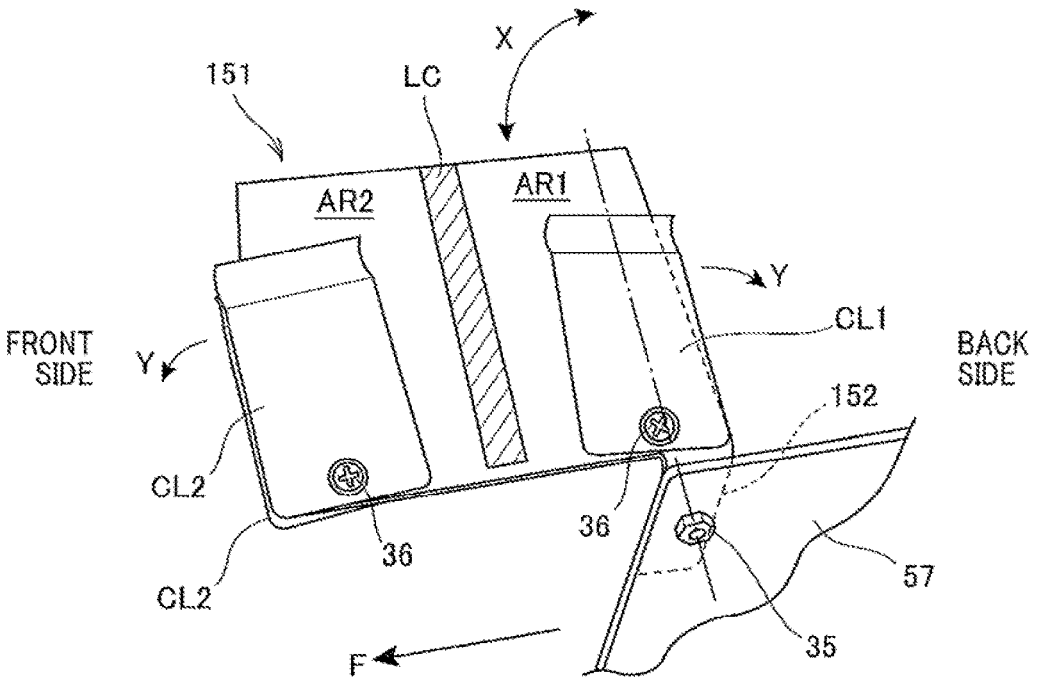
FIG. 6 is a diagram showing the peripheral construction of a working plate.

FIG. 6 shows the working plate 151 together with the peripheral construction thereof.

As shown in FIG. 6, the working plate 151 has one rectangular flat plate type metal plate, and one end corner portion thereof is secured to the partition plate 57 through a stay 152 by a fastening member (a bolt and a nut in this embodiment) 35. The working plate 151 is freely pivotally swingable around the fastening member 35 in an X direction of FIG. 6, and it can be tilted to the front side (the front surface side of the drug packaging device 1) and the back side (the back surface side of the drug packaging device 1).

The fastening member 35 is parallel to the shaft of the first feeding roller 53 which first guides the packaging sheet S drawn out from the roll 41. When the working plate 151 is tilted to the front side, the working plate 151 can be set along a flat plane M1 (see FIG. 4) which extends from the shaft of the first feeding roller 53 orthogonally to the front side (front surface side).

Furthermore, by tilting the working plate 151 to the back side (the back surface side of the drug packaging device 1), the back surface of the working plate 151 can be exposed to the front side or upper side.

A center line LC (see FIG. 6) representing the center between the front side and the back side is provided to both the surfaces of the working plate 151. A pair of upper and lower clips CL1 are provided at the back side of the center line LC, and a pair of upper and lower clips CL2 are provided at the front side of the center line LC. These clips CL1 and CL2 are pivotally swingable in a Y-direction along the surface of the working plate 151 around the respective fastening members (bolts and nuts in this embodiment) 36 for fastening the respective clips to the working plate 151. The center line LC is provided by attaching a plastic tape having a conspicuous color such as a fluorescent color or the like or printing it.

FIGS. 7A to 7D show the connection work of packaging sheets S which exchange of rolls involves.

Figure 7A:
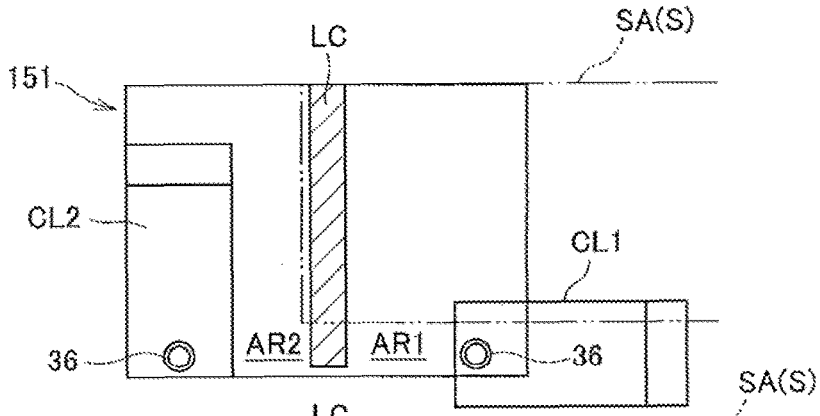
FIGS. 7A to 7D are diagrams showing a connecting work of packaging sheets which accompanies exchange of a roll sheet.
Figure 7B:
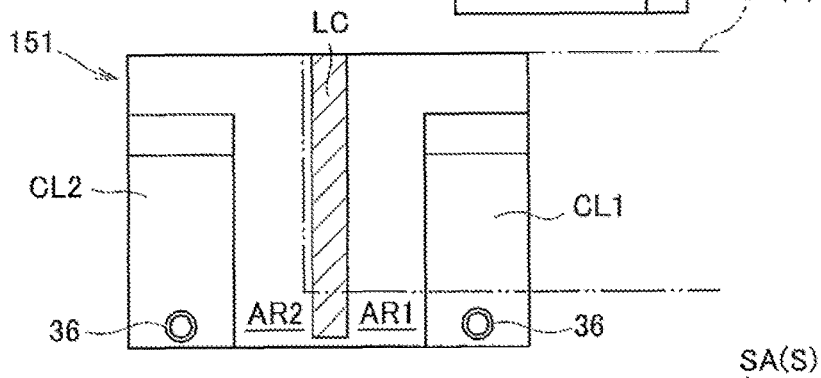

When the worker connects the packaging sheets S, the rear end portion SA of a residual packaging sheet S (represented by a two-dotted chain line in FIGS. 7A to 7D) of a used roll 41 is disposed in a first portion AR1 as a back side area of the center line LC of the working plate 151 while the clips CL1 are evacuated (FIG. 7A), and then the clips CL1 are returned, whereby the rear end portion SA of the packaging sheet S can be temporarily fixed (FIG. 7B).

Figure 8A:
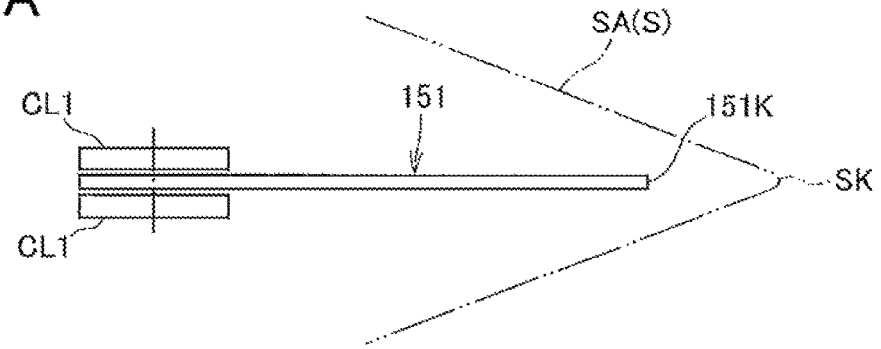
FIGS. 8 to 8C are side views of a temporarily fixing work of the packaging sheets.
Figure 8B:
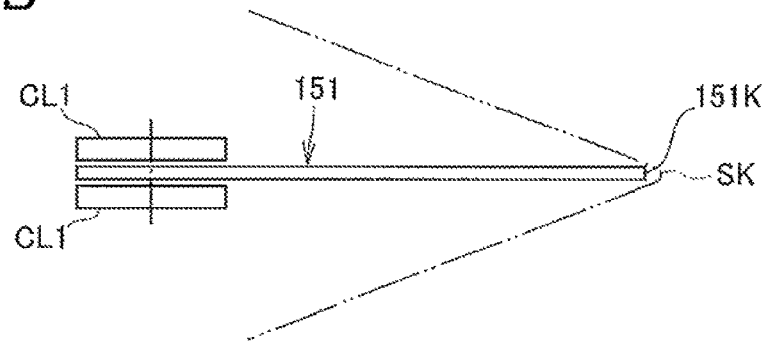
Figure 8C:
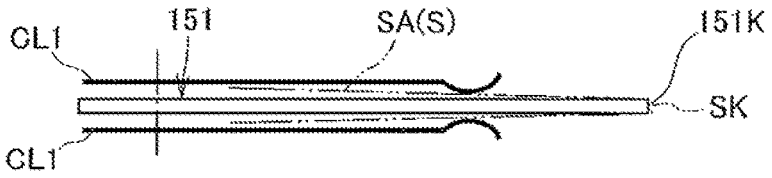

Here, FIGS. 8A to 8C are side views showing the temporarily fixing work of the packaging sheet S. As shown in FIGS. 8A to 8C, when the packaging sheet S is temporarily fixed, the rear end portion SA of the doubled packaging sheet S is spread to be V-shaped in section (FIG. 8A), and the folded portion SK as the apex is brought into contact with one side portion 151K of the working plate 151 (FIG. 8B). Under the above state, the rear end portion SA is clipped from the upper and lower sides by the pair of upper and lower clips CL1 (FIG. 8C). Since the packaging sheet S is temporarily fixed while the folded portion SK of the packaging sheet S is brought into contact with the one side portion 151K of the working plate 151 as described above the packaging sheet S can be accurately positioned at the same position every time.

As shown in FIG. 8C, the respective tips of the clips CL1 swell to the working plate 151, so that the packaging sheet S can be pressed by these tips.

Figure 7C:
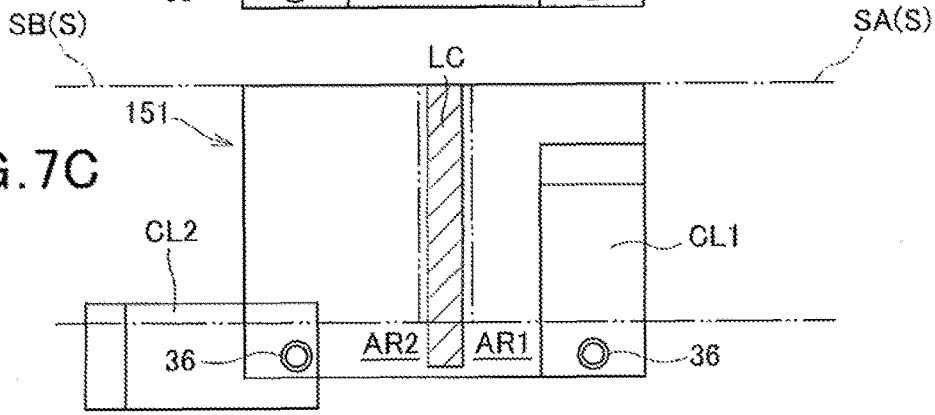
Figure 7D:
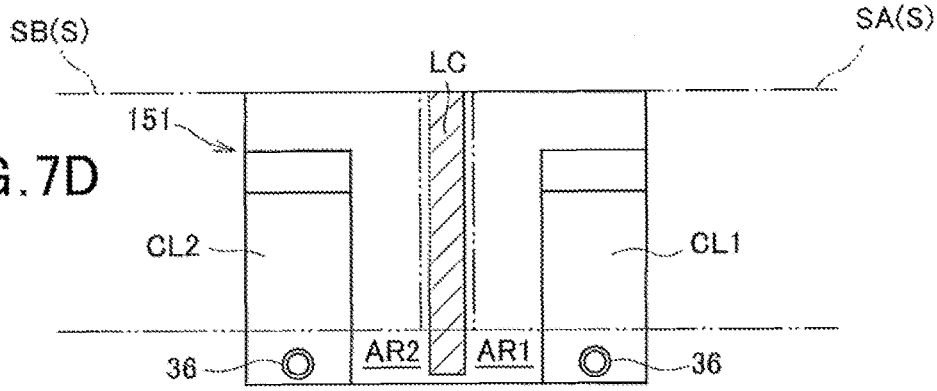

When the temporarily fixing work of the residual packaging sheet S of the used roll 41 is finished, the front end portion SB (represented by a two-dotted chain line in FIGS. 7A to 7D) of a packaging sheet S of a new roll 41 is disposed in a second portion AR2 as a front side area of the center line LC of the working plate 151 while the clips CL2 are evacuated as shown in FIG. 7C, and then the clips CL2 are returned, whereby the front end portion SB of the packaging sheet S can be temporarily fixed (FIG. 7D). In this case, as shown in FIGS. 8A to 8C, the packaging sheet S is temporarily fixed while the folded portion SK of the packaging sheet S is brought into contact with one side portion 151K of the working plate 151, whereby the packaging sheet S can be accurately positioned at the same position every time. Accordingly, the rear end portion SA of the packaging sheet S before the exchange and the front end portion SB of the packaging sheet S after the exchange can be easily aligned with each other on a straight line.

Subsequently, the end portion SB (or SA) of one of the packaging sheets S is covered on the end portion SA (or SB) of the other packaging sheet S on the center line LC while the center line LC is set as a mark, and both the packaging sheets are connected to each other by using a double-sided adhesive type connection tape (double-sided adhesive tape) or a one-sided adhesive type connection tape (one-sided adhesive tape). When this connection work or the temporarily fixing work is performed, the working plate 151 is properly swung to check the back surface of the packaging sheet S, whereby it can be easily checked whether both the doubled packaging sheets S are set under a proper state.

In this case, if the front end portion SB of the packaging sheet S of the new roll 41 to be subsequently temporarily fixed is covered, from outside, on the rear end portion SA of the packaging sheet S of the used roll 41 to be previously temporarily fixed, the superposing work can be smoothly performed. In addition, the front end portion SB of the packaging sheet S of the new roll 41 is not exposed to the inside of the doubted packaging sheet. Therefore, there is an advantage that the connection site does not obstruct the spreading work of the doubled packaging sheet S in the neighborhood of the nozzle 44, etc.

The present invention is not limited to the above style, and conversely, the front end portion SB of the packaging sheet S of the new roll 41 may be put in the rear end portion SA of the packaging sheet S of the used roll 41. In this case, the front end portion SB of the packaging sheet S of the new roll 41 is not exposed to the outside of the doubled packaging sheet. Therefore, the connection site does not obstruct the feeding work of the feeding roller 46, etc.

In the construction that the roll 41 is exchangeably mounted, the packaging sheet S wound around the roll 41 is fed under tension and filled with drugs, etc. as in the case of this embodiment, the feeding passage of the packaging sheet S is liable to be long and complicated. However, under this construction, this embodiment is provided with the working plate 151 having the first portion AR1 for temporarily fixing the end portion SA of the packaging sheet remaining at the nozzle (drug filling portion) 44 side and the second portion AR2 for temporarily fixing the end portion SB of the new packaging sheet S, and the end portions SA and SB of the respective packaging sheets S which are temporarily fixed to the first portion AR1 and the second portion AR2 are connectable to each other. Therefore, a worker can easily perform the connection work of both the packaging sheets S.

Furthermore, the first portion AR1 and the second portion AR2 are formed in one plate. Therefore, the work can be easily performed, and the construction is simple. Furthermore, the working plate 151 is located so as to be exposed to the front side when the front doors 8, 8 of the lower structure 4 are opened, which also facilitates the connection work of the packaging sheets.

In addition, as shown in FIG. 4, the working plate 151 of this embodiment is along the flat plane M1 extending in an orthogonal direction from the shaft of the first feeding roller 53 for feeding the packaging sheet S. Therefore, the rear end portion SA of the pre-exchange packaging sheet S can be easily directly moved to the first portion AR1 of the working plate 151 without removing the rear end portion SA from the first feeding roller 53, and the temporarily fixing work of an existing packaging sheet S can be easily performed.

Furthermore, the first feeding roller 53 is a feeding roller provided on the most upstream side of the feeding passage. Therefore, it is located on the upstream side of the movable roller 54 for applying tension to the packaging sheet S, etc. Therefore, the connection work of the packaging sheet S can be performed without removing the packaging sheet S from the feeding rollers 53 to 54 containing the movable roller 54, and a work of re-hanging the packaging sheet S is unnecessary.

Furthermore, since the working plate 151 is provided at a position where it is exposed to the front side when the front doors 8, 8 of the lower structure 4 are opened, the connection work of the packaging sheet S can be easily performed. The working plate 151 is provided to be freely swingable so that the obverse and reverse surfaces thereof can be exposed to the front side. Therefore, the posture of the working plate 151 can be adjusted so that the packaging sheet S can be easily temporarily fixed and the connection work can be more easily performed. Accordingly, the connection work of the doubled rolled packaging sheet S can be easily performed.

In addition, in this embodiment, the end portions SA, SB of the respective packaging sheets S can be connected to each other under the state that the packaging unit 18 is disposed in the lower structure 4. That is, as shown in FIG. 2 and FIG. 4, the sheet supply board 42 is disposed at the front lower side of the working plate 151 which is disposed at the front upper side. Therefore, the work can remove a pre-exchange roll 41 from the sheet supply board 42 attach a new roll 41, temporarily fix the end portion SA of the packaging sheet S at the pre-exchange roll 41 side to the working plate 151, temporarily fix the end portion SB of the packaging sheet S of the new roll 41 to the working plate 151, and connect both the packaging sheets S without drawing the packaging unit 18 from the inside of the lower structure 4 to the front side thereof. Accordingly, even when the working space at the front side of the drug packaging device 1 is narrow, the above work can be performed.

It is needless to say that the above work can be performed under the state that the packaging unit 18 is drawn from the lower structure 4 to the front side thereof.

In general, it is required to avoid a situation that drugs are filled to the connection site after the packaging sheets S are connected to each other as described above. In this case, if a FEED button or the like for feeding a packaging sheet is provided and the worker is required to operate the FEED button until the connection site has passed over the drug filling position, this work would be cumbersome, and this is not preferable.

Therefore, this embodiment, a detection sensor (detector) 161 (see FIG. 5) for detecting the connection site of the packaging sheets S is provided, and connection site skipping processing of skipping drug filling processing, etc. so that drugs are not filled to the connection site is executed on the basis of the detection result of the detection sensor 161.

<Detection Sensor>

Figure 9:
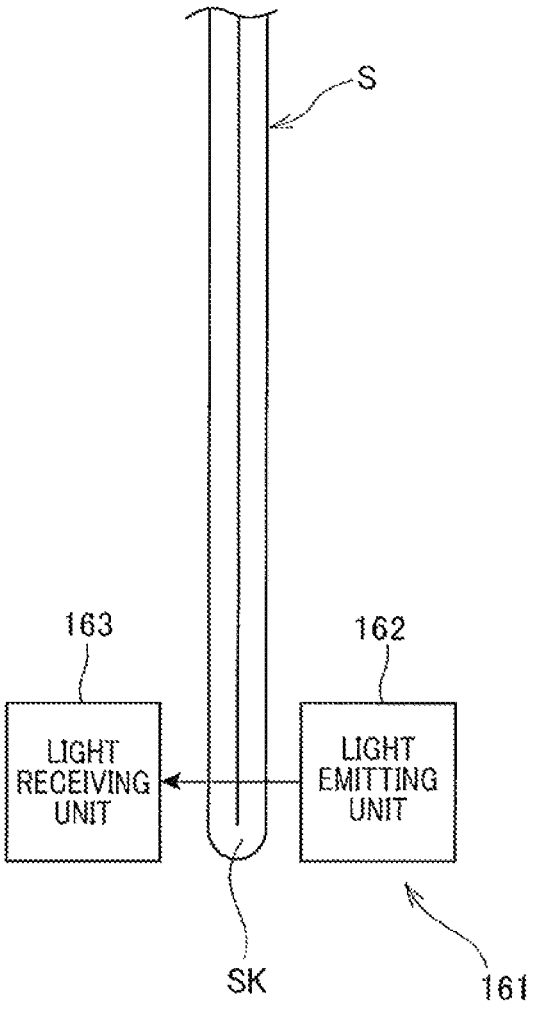
FIG. 9 schematically shows the construction of a detection sensor.

FIG. 9 is a diagram showing the construction of the detection sensor 161.

The detection sensor 161 is constructed by a transmission type optical sensor, and has a light emitting unit 162 for emitting inspection light to a packaging sheet S as a detection target, and a light receiving unit 163 for receiving the inspection light transmitted through the packaging sheet S. The connection site of the packaging sheet S is detected by detecting the difference in transmission light amount which is different between the connection site of the packaging sheet S and the other place.

Furthermore, the detection sensor 161 detects the transmission light amount in the neighborhood of the folded portion SK of the packaging sheet S. The transmission light amount in the neighborhood of the folded portion SK is detected because the presence or absence of a connection tape can be surely detected by adhesively attaching the connection tape so that the connection tape straddles over the folded portion SK when the packaging sheets S are connected to each other by using the working plate 151. Furthermore, a marking tape different from the connection tape (a tape represented by reference character TM in FIG. 11 described later) may be attached to the folded portion SK and detected. Since the folded portion SF is located at the open side (one side portion 151K side) of the working plate 151 the work of attaching the tape to the folded portion SK is easily performed.

The detection sensor 161 is located on the upstream side of the nozzle 44 for filling drugs, and more specifically, it is disposed between the printer unit 43 and the roller group 53 to 55 located upstream of the printer unit 43.

Figure 10:
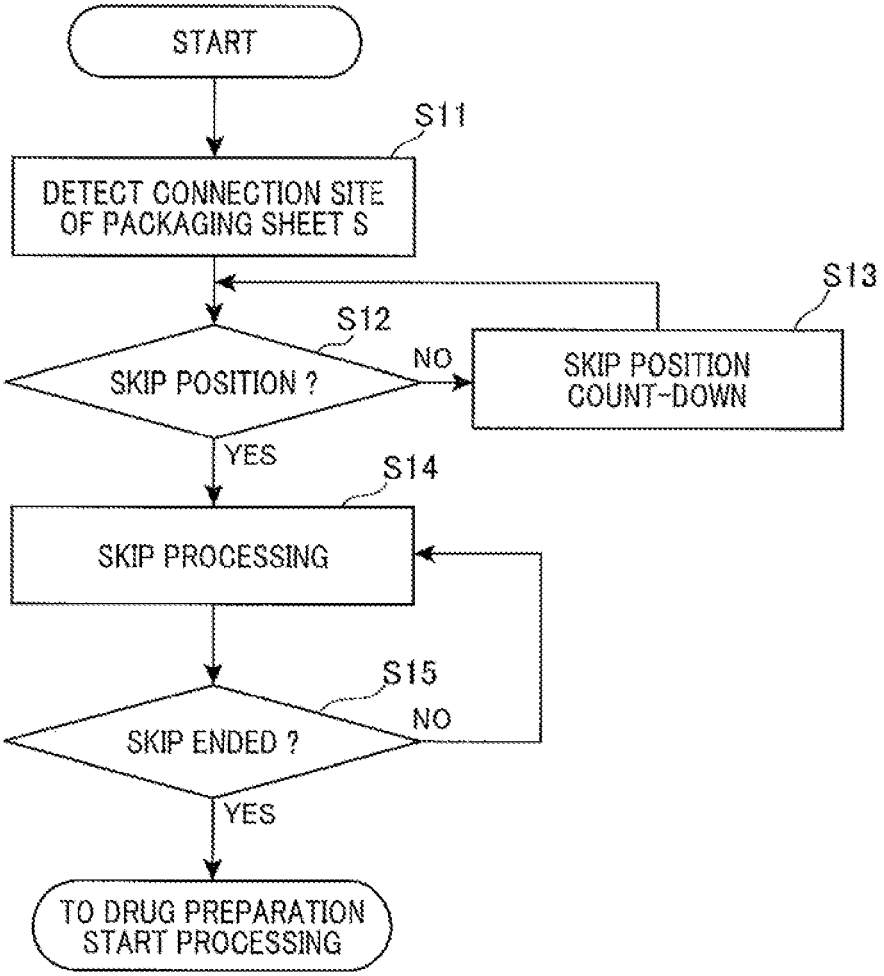
FIG. 10 is a flowchart showing connection site skip processing.
Figure 11:
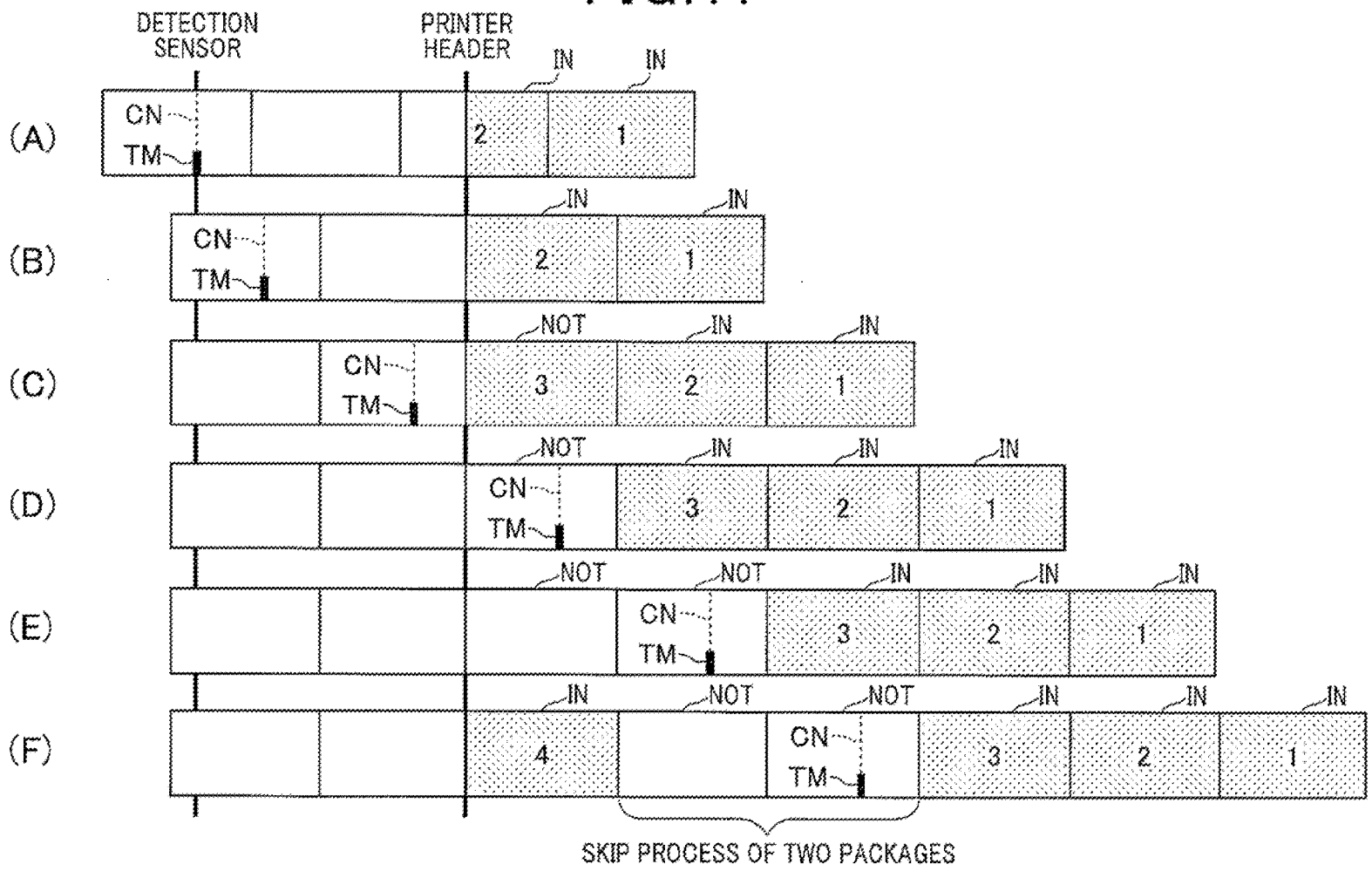
FIG. 11 schematically shows a packaging sheet in a time series manner.

FIG. 10 is a flowchart showing the connection site skip processing, and (A) to (F) of FIG. 11 are time-series diagrams of the packaging sheet S. The connection site skip processing is performed by executing a control program 127A through the controller 120.

As shown in FIG. 10, at a predetermined period (a period of 5 ms in this embodiment), the controller 120 detects on the basis of the detection sensor 161 whether there is a connection site of the packaging sheet S or not. When the connection site of the packaging sheet S is detected (step S11), the controller 120 executes skip position count-down processing (step S13) until the connection site reaches a skip position (step S12: NO).

The skip position count-down processing is the processing of counting the time from the detection of the connection site of the packaging sheet S until arrival of the connection site at the printer head as a skip start position. In this embodiment, the time concerned corresponds to the drug preparation time of one package, and it is determined whether drug preparation for one package is performed or not. When drug preparation for one package is performed, the controller 120 determines the skip position (step S12: YES), and starts skip processing of skipping predetermined processing containing drug filling processing (step S14).

In this skip processing, the controller 120 interrupts the print processing based on the printer unit 43 and the drug filling processing based on the nozzle 44 and continues the packaging processing based on the thermal seal head 45 and the feeding processing based on the conveyor 48 out of the processing involved by the drug preparation.

As described above, when the packaging processing and the feeding processing are executed without executing the drug filling processing, an empty package, that is, a blank package is generated. The controller 120 executes the skip processing to generate a blank package. Furthermore, the controller 120 counts the frequency of the skip processing, finishes the skip processing when the count value reaches a preset frequency (2 in this embodiment) (step S15: YES), and shifts to the drug preparation start processing. In this drug preparation start processing, the print processing and the drug filling processing which are being interrupted are resumed, and all the processing involved by the drug preparation (the print processing, the drug filling processing, the packaging processing, the feeding processing, etc.) can be executed.

In FIG. 11, the connection site of the packaging sheet S is represented by reference character CN, packages which are filled with drugs without being skipped are represented by reference character IN, and packages which are skipped and thus filled with no drug are represented by reference character NOT. As shown in FIG. 11, in this embodiment, a blank package is formed at a connection site CN, another blank package is also formed so as to be continuous with the connection site CN on the downstream side of the connection site concerned. The area corresponding to these two blank packages is not printed. Therefore, the packaging sheet S is also thermally sealed at the connection site CN portion as in the case of the other portions, and thus the connection site CN can be fed under the same condition by the feeding roller 46 and the conveyor 48. Furthermore, the area corresponding to a blank package is not printed, and thus "no print" enables the area to be externally visually recognized as being a blank package.

As described above, this embodiment is provided with the detection sensor (detector) 161 for detecting the connection site CN between the packaging sheet S remaining at the nozzle (drug filling unit) 44 side and the new packaging sheet S, and the controller 120 skips the processing of filling drugs to the connection site CN on the basis of the detection result of the detection sensor 161. Therefore, as compared with the conventional construction that a worker must operate the FEED button for feeding the packaging sheet, this embodiment can eliminate this type of operation, and the number of steps to be executed by the worker can be reduced with reducing waste of the sheet which is caused by sheet exchange.

Furthermore, the controller 120 skips the drug filling processing over plural times (twice in this embodiment) when the connection site CN passes over the nozzle 44. Therefore, the situation that drugs are filled into an area containing a connection site CN can be surely prevented.

In this embodiment, the skip frequency is set to twice. However, it may be three or more times. Furthermore, from the viewpoint that the area containing the connection site CN is surely prevented from being filled with drugs, it is preferable to increase the skip frequency as the package bag size is smaller. In this case, the skip frequency may be automatically changed in accordance with the set package bag size. When the package bag size is large and the area containing the connection site CN can be surely avoided from being filled with drugs by only one skip, the skip frequency may be set to once.

Furthermore, in this embodiment, the controller 120 continues packaging based on the thermal seal head 45 to generate blank packages whereas the drug filling processing is skipped at the connection site CN. Therefore, the packaging sheet S can be closed at even the connection site CN, and the packaging sheet can be surely and easily fed.

Furthermore, the controller 120 can skips the print processing based on the printer unit 43 at the connection site CN so that the area corresponding to a blank package is not printed. Therefore, "no print" on a package makes it easy to externally recognize that the package is a blank package, and a situation that a blank package is misidentified as being filled with drugs can be avoided. Furthermore, the detection sensor 161 is provided upstream of the printer unit 43 which is provided upstream of the packaging sheet S. Therefore, the connection site CN can be surely detected before the print processing, the drug filling processing and the packaging processing are executed.

Furthermore, in this embodiment, the marking tape TM (see FIG. 11) serving as a mark is provided to the connection site CN of the packaging sheet 3, and the detection sensor 161 detects the presence or absence of the marking tape TM. Therefore, the connection site CN of the packaging sheet S can be surely detected.

Figure 12:
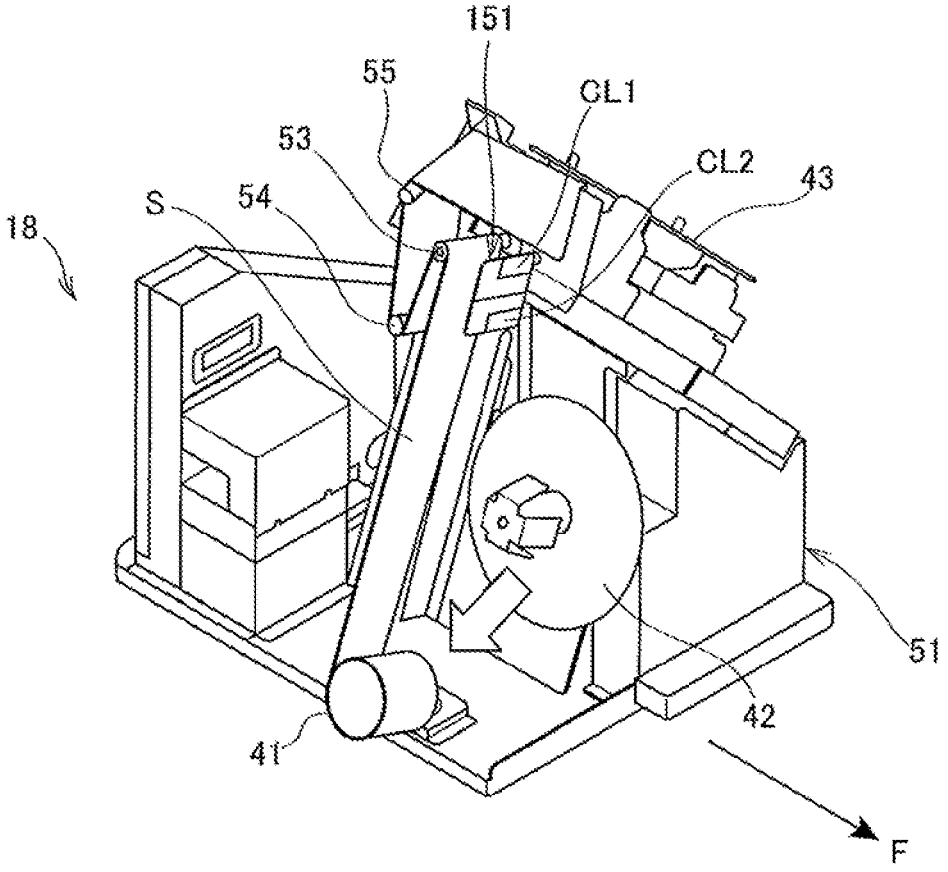
FIG. 12 is a perspective view showing a packaging unit according to a modification.

The above-described embodiment is merely an embodiment of the present invention, and any modification and application can be made without departing from the subject matter of the present invention. For example, in the above embodiment, the working plate 151 is provided to the partition plate 57. However, the present invention is not limited to this style, and the position and installation method of the working plate 151 are properly alterable. For example, as shown in FIG. 12, the working plate 151 may be provided in the neighborhood of the first feeding roller 53. Even in the construction shown in FIG. 12, the working plate 151 is provided at the position where it is exposed to the front side when the front doors 8, 8 of the lower structure 4 are opened, and it is provided freely swingably, whereby the working plate 151 can be oriented along the flat plane extending in the orthogonal direction from the shaft of the first feeding roller 53, and the connection work of the packaging sheet S can be facilitated.

Still furthermore, in the above embodiment, the working plate 151 is set along the flat plane M1 extending in the orthogonal direction from the shaft of the first feeding roller 53, whereby the temporarily fixing work of the packaging sheet S can be facilitated (see FIG. 4). However, the present invention is not limited to this style. For example, the temporarily fixing work of the packaging sheet S can be also facilitated by setting the working plate 151 along a flat plane extending in the orthogonal direction from the rotating shaft of the roll 41 mounted on the sheet supply board 42. Furthermore, the temporarily fixing work of the packaging sheet S can be also facilitated by setting the working plate 151 along the flat plane M1 as well as the above flat plane. That is, in the present invention, the working plate 151 may be set along the flat plane extending in the orthogonal direction from at least any one of the shaft of any feeding roller and the rotating shaft of the roll 41 within the range that the temporarily fixing work of the packaging sheet S can be facilitated.

Still furthermore, in the above embodiment, the controller 120 skips the print processing. However, the present invention is not limited to this style. It may be printed that the area corresponding to a blank package is a blank package (for example, characters of "blank package" may be printed) without skipping the print processing. Legibility of "blank package" is enhanced by this printing.

In the above embodiment, processing of measuring the feeding distance of the packaging sheet S or processing of measuring the packaging frequency of the packaging sheet S may be applied as the skip position count-down processing. That is, there may be applied the processing of measuring the feeding distance on the basis of the rotation amount of the feeding roller 46 or the like and determining whether this feeding distance reaches a distance by which the connection site of the packaging sheet S reaches the skip start position, or the processing of determining whether the packaging frequency of the packaging sheet S reaches a packaging frequency at which the connection site of the packaging sheet S reaches the skip start position.

The invention claimed is:

1. A drug packaging device configured to mount a roll sheet therein, the drug packaging device comprising:

a feeding mechanism for feeding the roll sheet to a drug filling unit while applying tension to the roll sheet;

a rectangular splicing plate secured at one corner thereof by a fastening member extending perpendicular from a partition plate so as to be freely pivotable about the fastening member, a center line dividing the splicing plate into two halves, wherein:

a first half of the splicing plate for temporarily fixing an end portion of the roll sheet remaining at a drug filling unit side; and a second half of the splicing plate for temporarily fixing an end portion of a new roll sheet such that the ends of the sheets temporarily fixed to the first half of the splicing plate and the second half of the splicing plate are connectable to each other;

wherein the first half of the splicing plate and the second half of the splicing plate are provided so as to be freely pivotable so that obverse and reverse surfaces thereof are exposable to a front side of the packaging device.

2. The drug packaging device according to claim 1, further comprising a housing in which the feeding mechanism is accommodated, the housing having a front door covering the feeding mechanism, and the plate is provided so as to be exposed to a front side when the front door is opened.

3. The drug packaging device according to claim 1 wherein the splicing plate is set along a flat plane extending in an orthogonal direction from at least any one of a shaft of a predetermined feeding roller of the feeding mechanism and a rotational shaft of a roll around which the sheet is wound.

4. The drug packaging device according to claim 3, wherein the feeding roller is located upstream of a movable roller that applies tension to the sheet.

5. The drug packaging device according to claim 1, wherein the end portions of the respective roll sheets are connectable to each other by being overlapped.

6. The drug packaging device according to claim 5, wherein the end portion of a new roll sheet is overlapped on the end portion of the roll sheet remaining at a drug filling unit side.

7. The drug packaging device according to claim 5, wherein the end portion of the roll sheet remaining at a drug filling unit side is overlapped on the end portion of a new roll sheet.

8. The drug packaging device according to claim 1 wherein the end portions of the respective sheets are connectable to each other under a state that a packaging unit containing the feeding mechanism is disposed in the drug packaging device.

9. The drug packaging device according to claim 1 wherein the roll sheet is a doubled rolled sheet.

10. The drug packaging device according to claim 1, further comprising a first pair of upper and lower clips provided on the first half of the splicing plate, and a second pair of upper and lower clips provided on the second half of the splicing plate, which are pivotally swingable along a surface of the splicing plate.

* * * * *